US007056228B2

(12) United States Patent
Beach et al.

(10) Patent No.: US 7,056,228 B2
(45) Date of Patent: Jun. 6, 2006

(54) GOLF CLUB HEAD PROVIDING ENHANCED ACOUSTICS

(75) Inventors: Todd P. Beach, San Diego, CA (US); Charles E. Golden, Encinitas, CA (US); Kraig A. Willett, Fallbrook, CA (US)

(73) Assignee: Taylor Made Golf Co., Inc., Carlsbad, CA (US)

( * ) Notice: Subject to any disclaimer, the term of this patent is extended or adjusted under 35 U.S.C. 154(b) by 0 days.

(21) Appl. No.: 11/124,316

(22) Filed: May 6, 2005

(65) Prior Publication Data

US 2005/0192119 A1 Sep. 1, 2005

Related U.S. Application Data

(63) Continuation of application No. 10/285,842, filed on Nov. 1, 2002, now abandoned.

(51) Int. Cl.
*A63B 53/04* (2006.01)

(52) U.S. Cl. ..... 473/345; 473/346

(58) Field of Classification Search ..... 473/324, 473/345, 346, 329, 349, 334, 332, 224, 234
See application file for complete search history.

(56) References Cited

U.S. PATENT DOCUMENTS

| | | | | |
|---|---|---|---|---|
| 1,592,463 | A * | 7/1926 | Marker | 473/342 |
| 1,658,581 | A * | 2/1928 | Tobia | 473/346 |
| 2,460,435 | A * | 2/1949 | Schaffer | 473/332 |
| 4,214,754 | A * | 7/1980 | Zebelean | 473/346 |
| 4,438,931 | A * | 3/1984 | Motomiya | 473/346 |
| 4,602,787 | A * | 7/1986 | Sugioka et al. | 473/338 |
| 5,328,176 | A * | 7/1994 | Lo | 473/342 |
| 5,410,798 | A * | 5/1995 | Lo | 29/527.2 |
| 5,429,365 | A * | 7/1995 | McKeighen | 473/346 |
| 5,624,331 | A * | 4/1997 | Lo et al. | 473/345 |
| 5,669,827 | A * | 9/1997 | Nagamoto | 473/345 |
| 5,718,641 | A * | 2/1998 | Lin | 473/224 |
| 5,755,627 | A * | 5/1998 | Yamazaki et al. | 473/345 |
| RE35,955 | E * | 11/1998 | Lu | 473/329 |
| 5,908,356 | A * | 6/1999 | Nagamoto | 473/224 |
| 5,941,782 | A * | 8/1999 | Cook | 473/346 |
| 5,997,415 | A * | 12/1999 | Wood | 473/346 |
| 6,162,133 | A * | 12/2000 | Peterson | 473/345 |

(Continued)

FOREIGN PATENT DOCUMENTS

JP 05-317465 * 5/1992

(Continued)

*Primary Examiner*—Sebastiano Passaniti
(74) *Attorney, Agent, or Firm*—Sheppard, Mullin, Richter & Hampton LLP

(57) ABSTRACT

An golf club head is provided, having enhanced sound and feel characteristics. The club head has a hollow main body including a ball-striking face, a sole, a crown, a hosel, and a side portion extending rearwardly from the face. The body further includes a heel region adjacent to the hosel and a toe region opposing the heel region, and it defines a volume of at least 100 cc. The club head further includes a stiffening member disposed within the body and attached to both the sole and the crown. The member is spaced apart from the striking face and disposed within the body in a region having a first zone extending less than half the distance from the heel region to the toe region and a second zone extending less than half the distance from a rearmost point, thereby forming a local stiffness zone in the body to influence vibration modes and acoustic properties of the club head in a prescribed manner.

18 Claims, 4 Drawing Sheets

U.S. PATENT DOCUMENTS

| | | | | |
|---|---|---|---|---|
| 6,299,547 | B1 * | 10/2001 | Kosmatka | 473/329 |
| 6,334,817 | B1 * | 1/2002 | Ezawa et al. | 473/324 |
| 6,383,090 | B1 * | 5/2002 | O'Doherty et al. | 473/329 |
| 6,390,933 | B1 * | 5/2002 | Galloway et al. | 473/345 |
| 6,524,197 | B1 * | 2/2003 | Boone | 473/324 |
| 2001/0049310 | A1 * | 12/2001 | Cheng et al. | 473/334 |
| 2002/0022535 | A1 * | 2/2002 | Takeda | 473/346 |
| 2002/0072434 | A1 * | 6/2002 | Yabu | 473/345 |

FOREIGN PATENT DOCUMENTS

| | | | |
|---|---|---|---|
| JP | 06-304271 | * | 4/1993 |
| JP | 09-327534 | * | 12/1997 |
| JP | 2773009 | * | 7/1998 |

* cited by examiner

GOLF CLUB HEAD PROVIDING ENHANCED ACOUSTICS

CROSS REFERENCE TO RELATED APPLICATIONS

This is a continuation of application Ser. No. 10/285,842, filed Nov. 1, 2002, now abandoned.

FIELD OF THE INVENTION

The invention relates generally to golf club heads and, more particularly, to hollow golf club heads having a volume of at least 100 cc.

BACKGROUND OF THE INVENTION

Traditional driver and fairway wood golf club heads are typically formed of steel or titanium alloys. For example, oversize driver heads, exceeding 300 cc in volume, are commonly formed of a titanium alloy such as Ti 6A1-4V. Many golfers particularly enjoy the aural and tactile feedback upon impact with a golf ball of club heads made of this lightweight yet strong alloy. Recent advances in club head design and materials have improved club performance, e.g., higher coefficient-of-restitution (COR), however, the resultant acoustic properties and vibrational responses can vary considerably from traditional club heads.

Although such clubs may provide improved performance, many golfers dislike the aural and tactile feedback they provide. As a result, some golfers continue to prefer traditional clubs. Attempts have been made to provide club heads to correct the acoustic properties and vibrational responses of modern clubs, often to the sacrifice of performance.

It should, therefore, be appreciated that there is a need for a golf club head having a high COR and improved acoustic and tactile feedback. The present invention fulfills this need and others.

SUMMARY OF THE INVENTION

The present invention provides a golf club head having enhanced sound and feel characteristics and a high COR. The club head has a hollow main body including a ball-striking face, a sole, a crown, a hosel, and a side portion extending rearwardly from the face. The body further includes a heel region adjacent to the hosel and a toe region opposing the heel region, and it defines a volume of at least 100 cc. The club head further includes a stiffening member disposed within the body and attached to both the sole and the crown. The member is spaced apart from the striking face and is configured to form a local stiffness zone within the body thereby affecting vibration modes and acoustic properties of the club head.

In a preferred embodiment of the invention, all portions of the member are closer to a rearmost point of the body than to a center point of the face.

In another preferred embodiment of the invention, the member is planar and is attached at the heel region, extending less than half the distance from the heel region to the toe region. The member is preferably vertically disposed between the crown and the sole and is oriented a prescribed angle relative to the face.

The member may comprise other shapes and may be connected along its second side end at the side portion. Preferably, the member is less than 2 mm thick and is more preferably about 1 mm thick. Other elements may be attached to the club head, as desired, and the member may be used to alter the sound producing modes of the club head.

A method of forming an oversize club head with an enhanced acoustic quality comprises forming a body, preferably of one or more titanium or steel alloys, and providing a stiffening member disposed within the body and attached to both the sole and the crown. The member is spaced apart from the striking face and is configured to form a local stiffness zone within the body thereby affecting vibration modes and acoustic properties of the club head. Casting or other methods known to those skilled in the art may be performed to form two or more portions of the body, and the face, sole and/or crown may be separately formed and attached. The member may be integrally cast with the portions of the body, or it may be welded to the inner surfaces of the body in a later manufacturing step. Additional elements may be attached or co-formed with the body, as desired.

Although the member may comprise a planar, solid element, it may alternatively include cutouts along one or more of its sides, and/or it may include one or more openings. The reduction in mass of the member due to the cutouts and/or openings is such that the local stiffening properties of the club head are still achieved.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
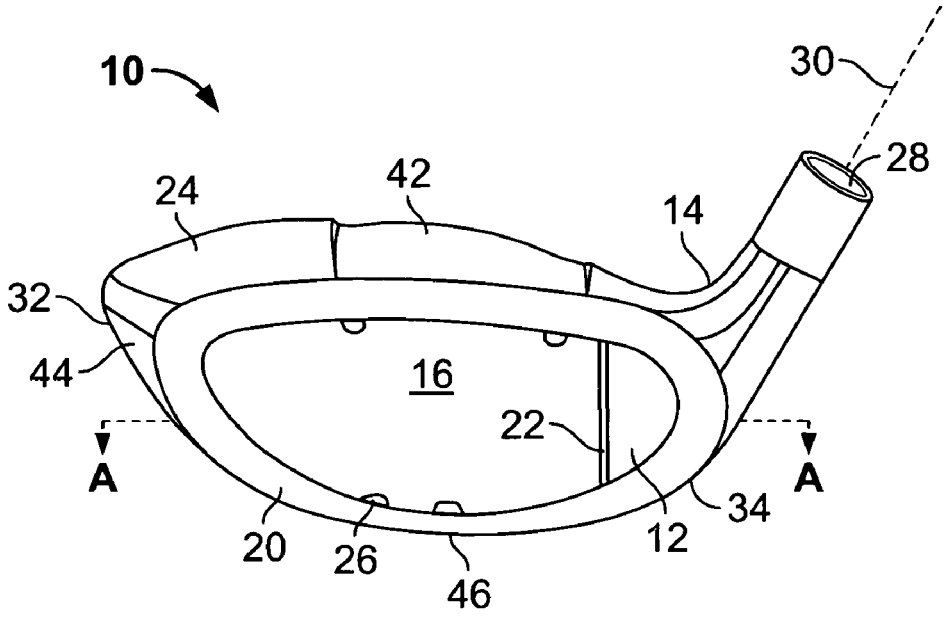
FIG. 1 is a front perspective view of a partially assembled club head in accordance with the invention, having a striking plate removed from the front of the club head and showing a stiffening member within the cavity.
Figure 1A:
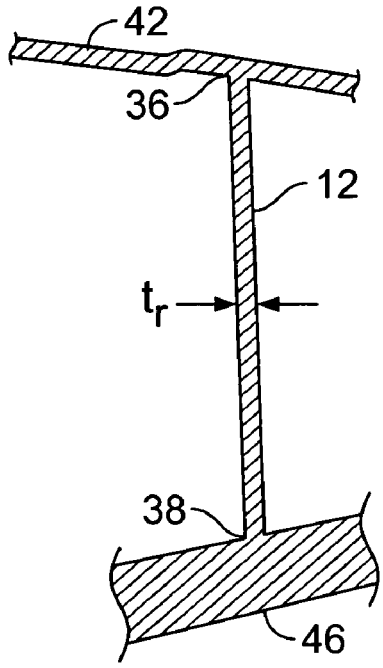
FIG. 1A is a cross-sectional view of the stiffening member, depicting the stiffening member extending between a top portion and bottom portion of the club head of FIG. 1.

With reference to the illustrative drawings, and particularly to FIGS. 1 and 1A, there is shown a club head 10 having a stiffening member 12 for stiffening a region around a hosel 14 within an interior 16 of the club head 10. The hosel 14 is configured to receive a shaft (not shown) of the club. The stiffening member 12 is spaced apart from a striking plate 18 (FIG. 2) located at a front portion 20 of the club head 10. In a preferred method of construction, a body 24 of the club head 10 is cast having a front opening 26 at the front portion 20 to which the striking plate 18 is later welded.

The preferred materials for the club head 10 include titanium alloys, such as Ti 6A1-4V, and may be alpha, alpha-beta or beta type alloys. Alternatively, the club head 10 may be formed of steel alloys such as Carpenter Custom 450® and/or Custom 455® stainless steel.

The hosel 14 includes hosel opening 28 for the insertion of a tip end of a club shaft (not shown) and an axis 30 is defined corresponding to the central axis of the shaft. The club head 10 has toe region 32 spaced apart from the hosel 14 and a heel region 34 adjacent to the hosel 14. A width W of the club head 10 is measured between a point $P_1$ at a toe region 32 and a heel region 34. A depth D of the club head 10 is measured from a center point C of the striking plate 18 to a rearmost point $P_2$.

Figures 2, 3, 4:
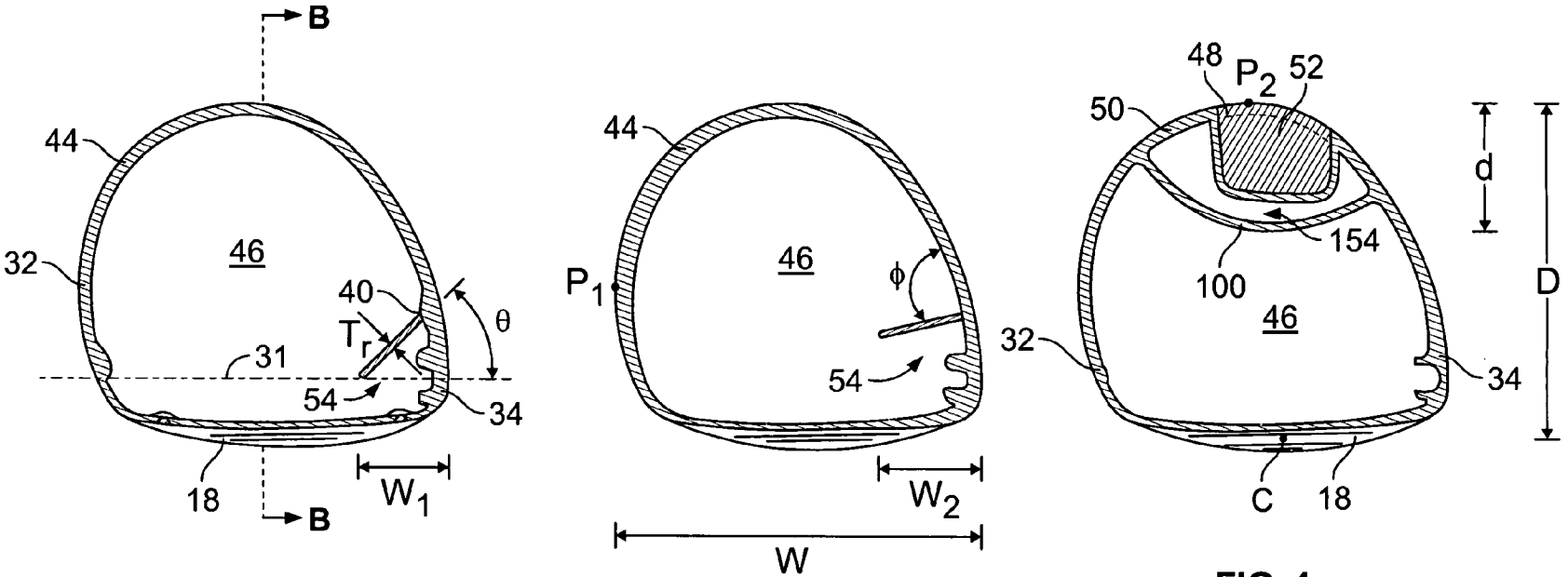
FIG. 2 is a top cross-sectional view of the club head of FIG. 1 taken along line A—A, depicting the orientation of the stiffening member.
FIG. 3 is a top cross-sectional view similar to FIG. 2 of a second preferred embodiment of a club head in accordance with the invention.
FIG. 4 is a top cross-sectional view similar to FIG. 2 of a third preferred embodiment of a club head in accordance with the invention.

Referring to FIG. 1A, the connection of top and bottom ends 36, 38 of the stiffening member 12 to the body 24 are more clearly shown, and referring to FIG. 2, the connection of a rear side end 40 of the stiffening member 12 is shown. The stiffening member 12 may be integrally formed with the portions of the club head 10 using known casting methods, or alternatively the stiffening member 12 may be welded to inner surfaces of a crown 42, side portion 44 and sole 46 of the club head 10. The stiffening member 12 may be of a metallic material that is forged, cast, stamped or otherwise shaped for use; or it may be of a non-metallic material, such as from a polymer, plies of fiber-reinforced resin, and the like.

Preferably, the stiffening member 12 is planar and of a constant thickness $t_r$ of less than 2 mm. More preferably, the stiffening member 12 has a thickness of about 1 mm, which is sufficient to modify the vibrational modes of the club head 10. Alternatively, the stiffening member 12 may have a non-constant thickness or a thickness approximately the same as one of the portions of the club head 10 connected to the stiffening member 12, ranging from about 0.7 mm to 3 mm. In addition, the stiffening member 12 may be a solid piece or have one or more openings forming a truss-like structure, as desired. The overall stiffness of the stiffening member 12 relative to the adjacent portions of the club head 10 should be sufficient to provide the desired vibration mode modifications.

FIGS. 2 and 3 show different orientations of the stiffening member 12 at the region around the hosel 14. In FIG. 2 the stiffening member 12 is at an angle θ about 45 degrees relative to a vertical plane containing a point on the axis 30 and a horizontal line 31 that is substantially parallel to the striking plate. Alternatively, the stiffening member 12 may be formed as in FIG. 3 at an angle θ that is at about 90 degrees relative to a substantially vertical plane that is tangent to the side portion 44 at the junction with the stiffening member 12. In both embodiments the stiffening member 12 extends a distance $W_1$, $W_2$ respectively that is less than half the distance W from the heel region 34 to the toe region 32, and preferably the stiffening member 12 extends less than one-third the distance W.

Another preferred embodiment of the present invention is shown in FIG. 4, and it includes a recess 48 at a rear region 50 of the body 24 that contains a weight element 52. The weight element 52 may comprise a metal or polymeric material, or a combination thereof. A stiffening member 100 substantially alters the modes involving the weight element 52 by utilizing a curved shape to minimize the interior space encompassed by the stiffening member 100. The stiffening member 100 extends a distance d that is less than half the distance D from the rearmost point $P_2$ to the striking plate 18.

Figure 5:
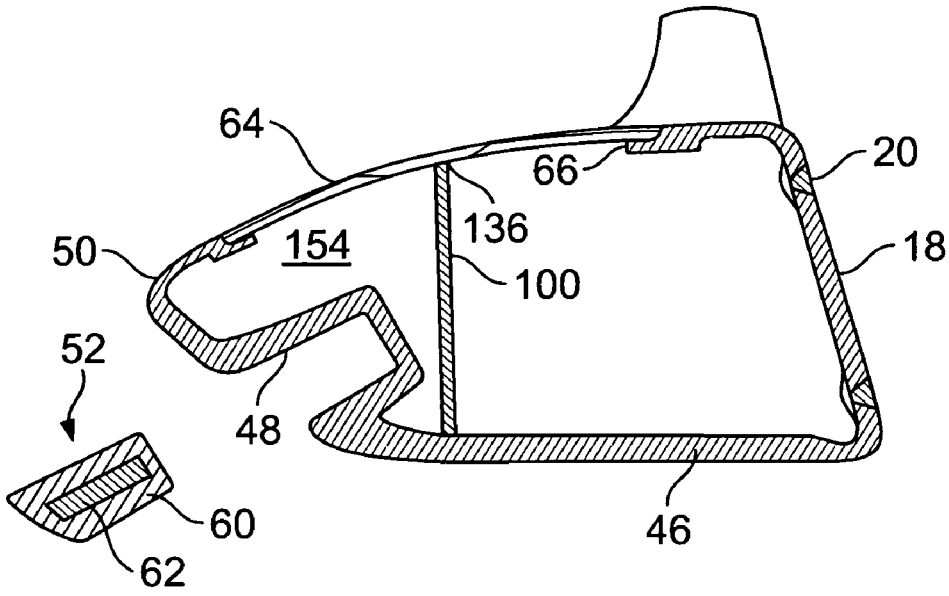
FIG. 5 is a side cross-sectional view similar to one taken along line B—B of FIG. 2 of a fourth preferred embodiment a club head in accordance with the invention, depicting a removable weight and a stiffening member adjacent thereto.

The region around the hosel 14 of FIGS. 1–3 and 6 and the rear region 50 of FIGS. 4 and 5 each comprise a local stiffness zone 54, 154 that is defined by the stiffening member 12, 100 and the crown 42, sole 46 and side portion 44 of the body 24 of the club head 10. In the former, the local stiffness zone 54 is open between the hosel opening and the remainder of the cavity at the unconnected side end 22 of the stiffening member 12. In the latter, the local stiffness zone 154 encompasses the weight element 52 and all of the ends of the stiffening member 100 are connected to the body 24.

Referring in detail to FIG. 5, an alternative embodiment is shown having the weight element 52 comprise a polymeric housing 60 with a metal rod 62 contained therein. In addition, a lightweight crown piece 64 is attached to a top opening 66 at the top of the club head 10. In this construction, the body 24 may comprise a cast portion including the sole 46 and side portion 44, with top and front openings 66, 26 formed in the top and front, respectively, to receive the separately formed crown piece 64 and striking plate 18, respectively. Although the stiffening member 100 is shown to be substantially straight in a vertical direction, it is understood that a more curved shape may be used to further minimize the local stiffness zone 154 encompassed by the stiffening member 100. The stiffening member 100 may be cast with a portion of the body 24, such as the sole 46, with a top end 136 later attached to the crown piece 64 through the front opening 26 at the front of the club head 10.

Figure 6:
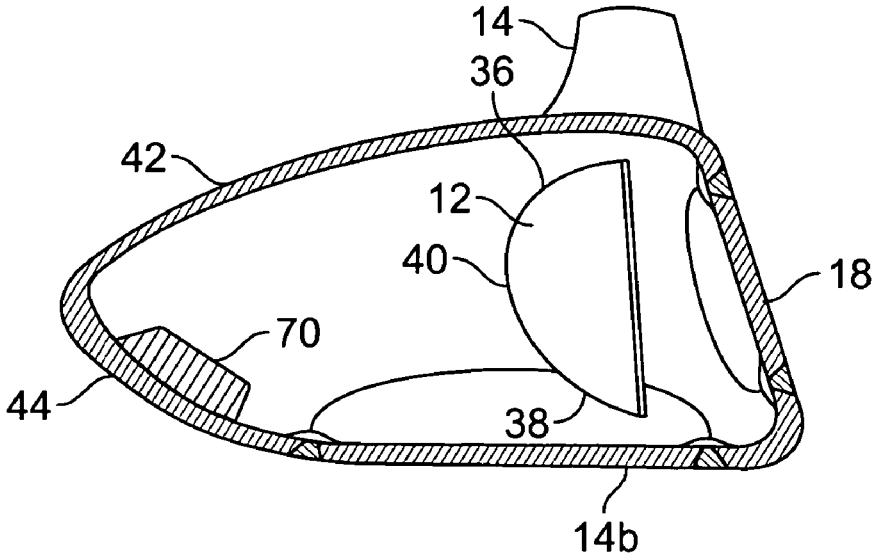
FIG. 6 is a side cross-sectional view similar to FIG. 5 of a fifth preferred embodiment of a club head in accordance with the invention, depicting a weight pad and a stiffening member oriented toward and spaced apart from the striking face.

FIG. 6 shows another embodiment having a stiffening member 12 at the region around the hosel 14 wherein both the striking plate 18 and a sole plate 146 are separately formed and attached to appropriate openings formed in the club head 10. (The attachment is shown in dashed lines.) In this construction, the body 24 may comprise a cast portion including the crown 42 and side portion 44, with the stiffening member 12 integrally formed with the crown 42 and side portion 44 along its top and rear side ends 36, 40. The bottom end 38 of the stiffening member 12 may be attached to the sole plate 146, such as by welding, through the front opening 26 at the front of the club head 10. Alternatively, one or more additional elements such as a metallic weight 70 may be attached to an inner surface of the body 24 prior to attachment of the sole plate 146 and/or striking plate 18.

The present invention further comprises a method of enhancing the acoustic quality of a golf club head 10 having a volume of at least 100 cc, preferably at least 110 cc and more preferably at least 150 cc. The method includes forming a body 24 having top, front, side and bottom portions to define a cavity The method further includes providing a stiffening member to define a local stiffness zone within the cavity. The body 24 has heel, toe and rear regions 32, 34, 50. The stiffening member is located within the body 24 either heelward or rearward. The stiffening member is connected to at least the top and bottom portions, and the resulting local stiffness zone substantially alters the vibration modes of the head 110. Preferably, the stiffening member is also connected to the side portion along at least one side end of the stiffening member. The completion of the step of forming the body may be performed after the stiffening member is connected therein. That is, the top, front and/or bottom portions of the club head 10 may be attached after the stiffening member is provided to define the local stiffness zone. Additional elements, such as a weight, may also be provided in the club head 10 prior to completion of the step of forming the body 24.

Figure 7:
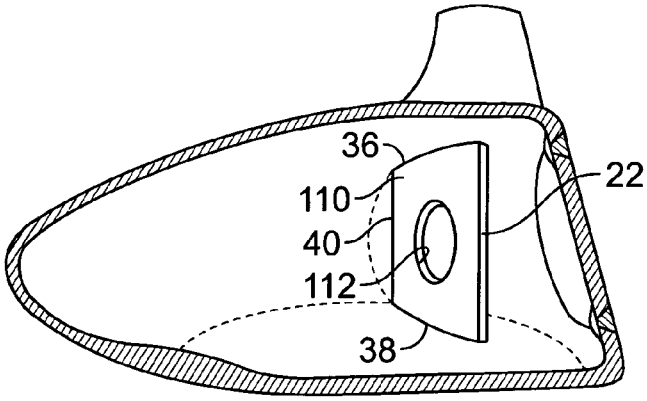
FIG. 7 is a side cross-sectional view similar to FIG. 5 of a sixth preferred embodiment of a club head in accordance with the invention, depicting another preferred configuration of the stiffening member.
Figure 8:
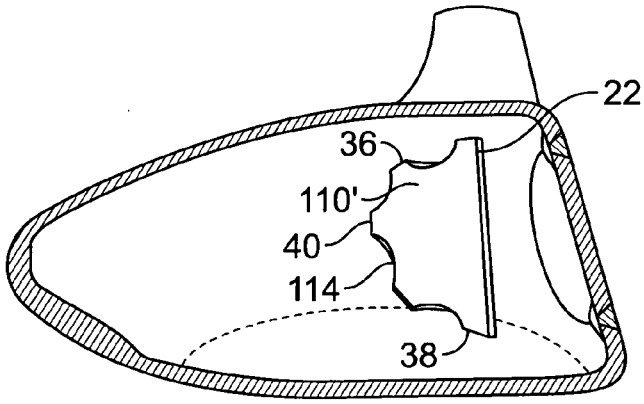
FIG. 8 is a side cross-sectional view similar to FIG. 5 of a seventh preferred embodiment of a club head in accordance with the invention, depicting yet another preferred configuration of the stiffening member.
Figure 9:
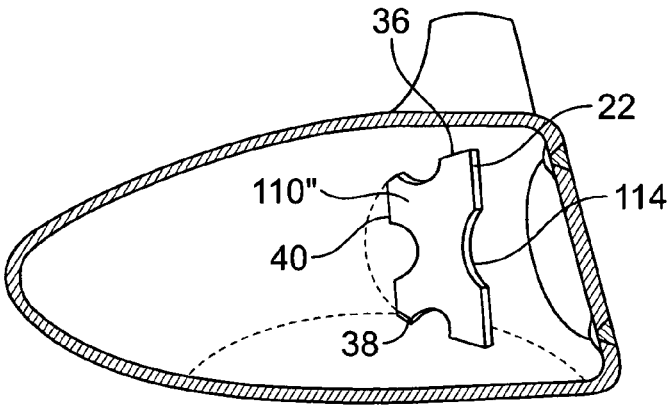
FIG. 9 is a side cross-sectional view similar to FIG. 5 of an eighth preferred embodiment of a club head in accordance with the invention, depicting yet another preferred configuration of the stiffening member.

As shown in FIGS. 7–9, the stiffening member 110, 110' and 110" may be other than a solid piece. As shown in FIG. 7, one or more openings 112 may be formed in the stiffening member. One Alternatively, as shown in FIGS 8 and 9, one or more cutouts 114 may be included along any or all of the top, bottom and side ends of the stiffening member. The inclusion of one or more of the openings 112 and/or cutouts 114 provides a reduction in mass for the stiffening member that may be desirable, as long as the stiffening properties of the stiffening member are maintained.

Although the invention has been disclosed in detail with reference only to the preferred embodiments, those skilled in the art will appreciate that additional golf club heads can be made without departing from the scope of the invention. Accordingly, the invention is defined only by the claims set forth below.

We claim:

1. A golf club head comprising:

a hollow body delimited by a striking plate, a sole, a crown, a hosel, and a side portion extending rearwardly from the striking plate, the hollow body having a heel region adjacent to the hosel, a toe region opposing the heel region, and a maximum club head width measured between the heel region and the toe region;

a first zone disposed within the hollow body and extending less than half the maximum club head width from the outermost heel region towards the toe region; and a stiffening member completely disposed within the first zone and extending away from the heel region between the heel region and the toe region, wherein the stiffening member is spaced apart from the striking plate and directly coupled to at least the sole and the crown.

2. The golf club head of claim 1, wherein the stiffening member is directly coupled to the side portion.

3. The golf club head of claim 1, wherein the stiffening member has at least one opening formed therein.

4. The golf club head of claim 1, wherein the stiffening member has at least one cutout farmed in at least one of a top end, a bottom end, and a rear side end of the stiffening member.

5. The golf club head of claim 1, wherein the stiffening member is substantially planar.

6. The golf club head of claim 1, wherein the thickness of the stiffening member is within a range of 0.7 mm to 3 mm.

7. The golf club head of claim 1, wherein all portions of the stiffening member are closer to a rearmost point of the body than to a center point of the striking plate.

8. The golf club head of claim 1, wherein the stiffening member is positioned between 0 and 45 degrees relative to a vertical plane containing a point on a hosel axis and a horizontal line substantially parallel to the striking plate.

9. The golf club head claim 1, wherein the stiffening member is positioned about 90 degrees relative to a substantially vertical plane tangent to the side portion at a junction of the stiffening member and the side portion.

10. A golf club head comprising:

a hollow body delimited by a striking plate, a sole, a crown, a hosel, and a side portion extending rearwardly from the striking plate, the hollow body having a heel region adjacent to the hosel and a toe region opposing the heel region, and a maximum club head width measured between the heel region and the toe region;

a first zone disposed within the hollow body and extending less than one-third the maximum club head width from the outermost heel region to the toe region; and a stiffening member completely disposed within the first zone and extending away from the heel region between the heel region and the toe region, wherein the stiffening member is spaced apart from the striking plate and directly coupled to at least one of the sole and the crown.

11. The golf club head of claim 10, wherein the stiffening member is directly coupled to the side portion.

12. The golf club bead of claim 10, wherein the stiffening member is substantially planar.

13. The golf club head of claim 10, wherein the stiffening member has at least one opening formed therein.

14. The club head of claim 10, wherein the stiffening member has at least one cutout formed in at least one of a top end, a bottom end, and a rear side end of the stiffening member.

15. The club head of claim 10, wherein the thickness of the stiffening member is within a range of 0.7 to 3 mm.

16. The golf club head of claim 10, wherein all portions of the stiffening member are closer to a rearmost point of the body than to a center point of the face.

17. The golf club head of claim 10, wherein the stiffening member is positioned between 0 and 45 degrees relative to a vertical plane containing a point on a hosel axis and a horizontal line substantially parallel to the striking plate.

18. The golf club head of claim 10, wherein the stiffening member is positioned about 90 degrees relative to a substantially vertical plane tangent to the side portion at a junction of the member and the side portion.

* * * * *

UNITED STATES PATENT AND TRADEMARK OFFICE

CERTIFICATE OF CORRECTION

PATENT NO. : 7,056,228 B2
APPLICATION NO. : 11/124316
DATED : June 6, 2006
INVENTOR(S) : Todd P. Beach et al.

It is certified that error appears in the above-identified patent and that said Letters Patent is hereby corrected as shown below:

At column 1, line 5, “Applications” should be -- Application --.

At column 4, line 62, “hosel 14” should be -- hosel 14, --.

At column 5, line 15, “a cavity The” should be -- a cavity. The --.

At column 5, line 35, before “Alternatively” delete “One”.

At column 6, line 4, “farmed” should be -- formed --.

At column 6, line 42, “bead” should be -- head --.

Signed and Sealed this

Thirtieth Day of January, 2007

JON W. DUDAS
*Director of the United States Patent and Trademark Office*